US005551180A

United States Patent [19]

Findlay et al.

[11] Patent Number: 5,551,180

[45] Date of Patent: Sep. 3, 1996

[54] FIREARM BOLT LOCK MECHANISM

[75] Inventors: David S. Findlay, Elizabethtown; Fred E. Martin, Radcliff; James W. Ronkainen, Elizabethtown, all of Ky.

[73] Assignee: Remington Arms Company, Inc., Wilmington, Del.

[21] Appl. No.: 399,795

[22] Filed: Mar. 7, 1995

[51] Int. Cl.[6] ..... F41A 17/32

[52] U.S. Cl. ..... 42/70.01

[58] Field of Search ..... 42/69.02, 70.01, 42/70.04, 70.05, 70.06

[56] References Cited

U.S. PATENT DOCUMENTS

| | | | |
|---|---|---|---|
| 947,066 | 1/1910 | Tambour | 42/70.01 |
| 2,869,269 | 1/1959 | Couture | 42/70.01 |
| 3,782,022 | 1/1974 | Bielfeldt et al. | 42/70.01 |
| 4,305,218 | 12/1981 | Godsey | 42/70.01 |
| 4,730,406 | 3/1988 | Forbes et al. | 42/70.01 |
| 4,870,770 | 10/1989 | Forbes et al. | 42/70.01 |

*Primary Examiner*—Stephen C. Bentley
*Attorney, Agent, or Firm*—Donald W. Huntley

[57] ABSTRACT

A releasable bolt lock for two position safety firearms which can be actuated separate from the safety lever and which allows the unloading of the rifle with the safety in the "safe" or "on" position.

4 Claims, 3 Drawing Sheets

2
5
8
9
9A
10
11
12
13
14
15
16
17

FIREARM BOLT LOCK MECHANISM

BACKGROUND OF THE INVENTION

This invention relates to firearms having an improved bolt lock mechanism and a safety actuating means. Firearms are generally equipped with a safety mechanism. The safety mechanism inhibits accidental firing of the firearm when the safety is moved to a safe position. The safety mechanism also typically controls the bolt lock mechanism. Thus, moving the safety to the safe position automatically moves the bolt lock to the locked position, and moving the safety to a fire position automatically moves the bolt lock to an unlocked position.

The safety mechanism disclosed in Godsey, U.S. Pat. No. 4,305,218, is representative of prior mechanisms. That patent discloses a three position safety mechanism for a firearm. This safety mechanism has a bolt lock function which is part of the safety. Thus, in the first safe position the firearm cannot be discharged and the bolt is locked. The second safe position continues to lock the trigger but lets the bolt be unlocked. The third position of the safety lets one fire the firearm by pulling the trigger and releases the bolt, permitting its movement in reloading the firearm.

Previous firearm bolt lock mechanisms with two position safeties have generally been directly or pivotally connected to safety lever arm. If the safety is in the "on" position the bolt was locked. When the safety is in the "fire" position the bolt was released to reload the firearm after every shot.

SUMMARY OF THE INVENTION

The present invention provides a bolt lock mechanism for two position safety firearm designs that is releasable and separate from the safety lever actuating arm. This is accomplished by providing a slidable connection between the safety and the bolt lock mechanism. The present invention thus provides the firearm user greater flexibility in unloading or using the firearm. The placement of the bolt lock mechanism and the safety mechanism in the present invention is such that they can easily be controlled by a firearm operator and remain separate from one another.

Specifically, the present invention provides, in a firearm having a fire control mechanism, a two position safety, a safety actuating means to move the fire control mechanism between a safe and a fire position, and a bolt lock assembly, the improvement wherein the bolt lock assembly comprises a pivotally mounted locking member to move between a locked and an unlocked position, the bolt lock having a tab which secures the bolt in the locked position and downwardly and rearwardly extending portion which slideably interacts with the safety actuating means, the locking member having an upwardly projecting control means for moving the locking member between a locked and an unlocked position; and a spring and an associated spring keeper, the spring biasing the bolt lock to the locked position; the arcuate portion of the locking member slideably interacting with the safety in a manner such that moving the safety from a fire to a safe position moves the bolt lock from an unlocked to a locked position; and wherein the upwardly projecting control means can manually overcome the spring bias to move the bolt lock to an unlocked position.

DETAILED DESCRIPTION OF THE INVENTION

Figure 1:
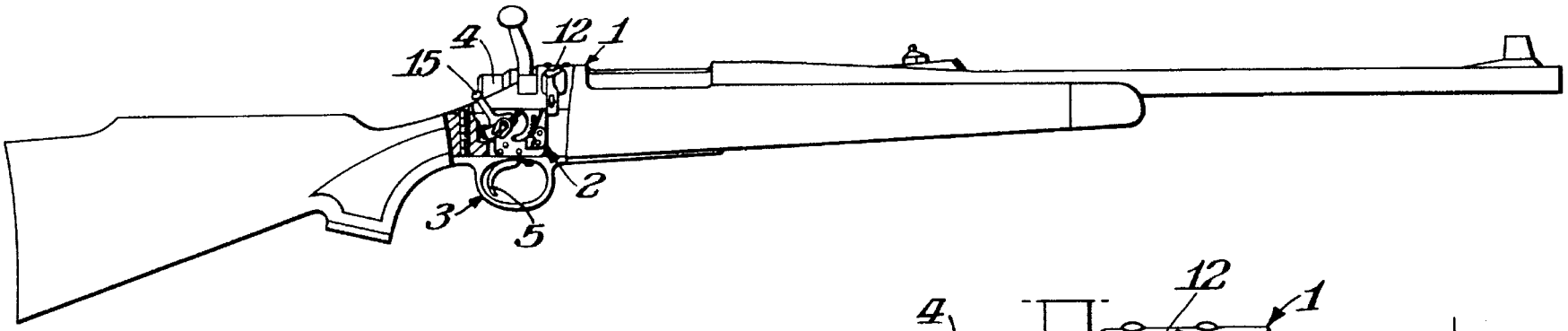
FIG. 1 is a side elevational view of a rifle of the present invention.
Figure 1A:
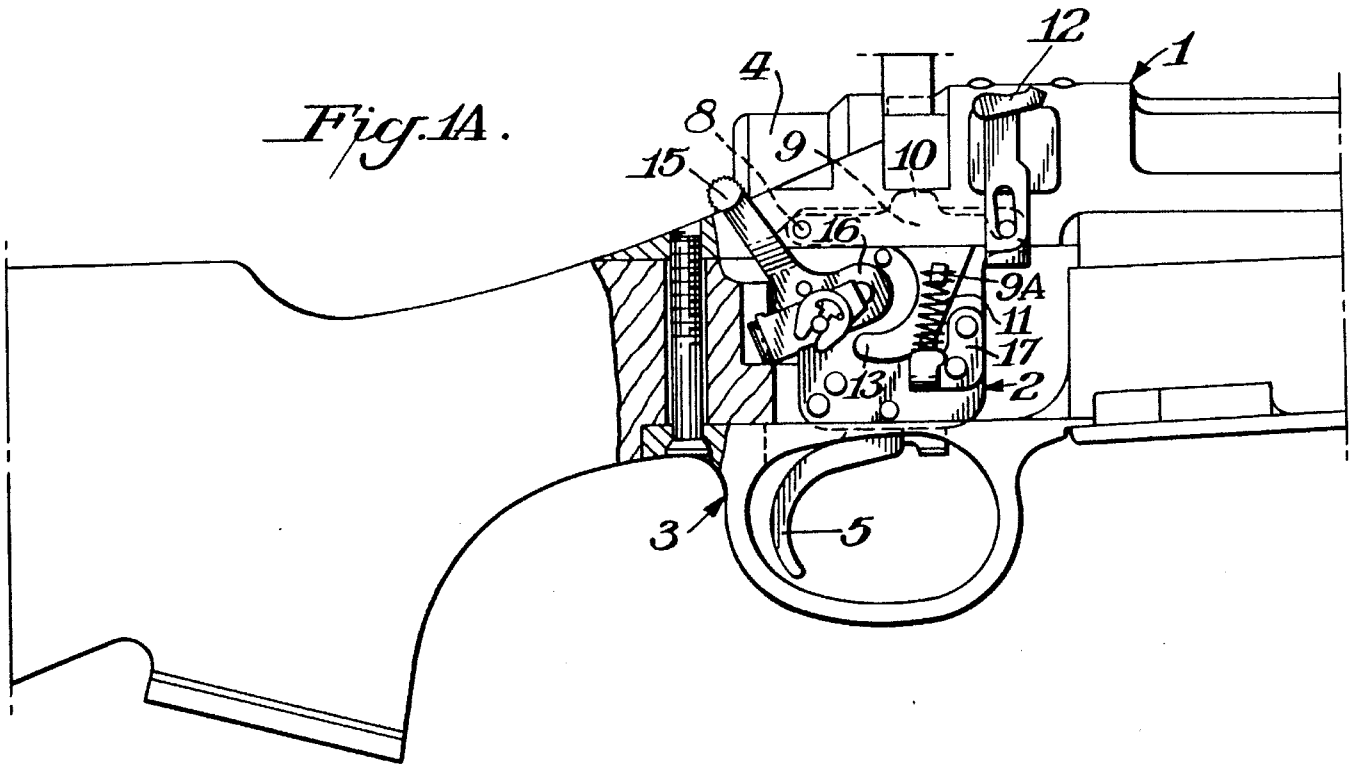
FIG. 1A is an enlarged side sectional view of a portion of a rifle of FIG. 1, showing installation of a bolt lock mechanism in accordance with the invention.

This invention represents an improvement in the bolt lock mechanisms for firearms and can be more fully understood by reference to the drawings, in which FIG. 1 shows the bolt lock mechanism mounted in a conventional firearm, in accordance with the invention. A receiver 1 serves as a housing for the bolt lock mechanism 2, and a trigger housing 3. A bolt 4, present just above the bolt lock mechanism 2, is secured by a locking tab 10 when the bolt lock is in a locked position. FIG. 1 shows the safety mechanism 17 in a safe position, thereby engaging the trigger 5 and preventing the firing of the rifle.

Figures 2, 3, 4, 5:
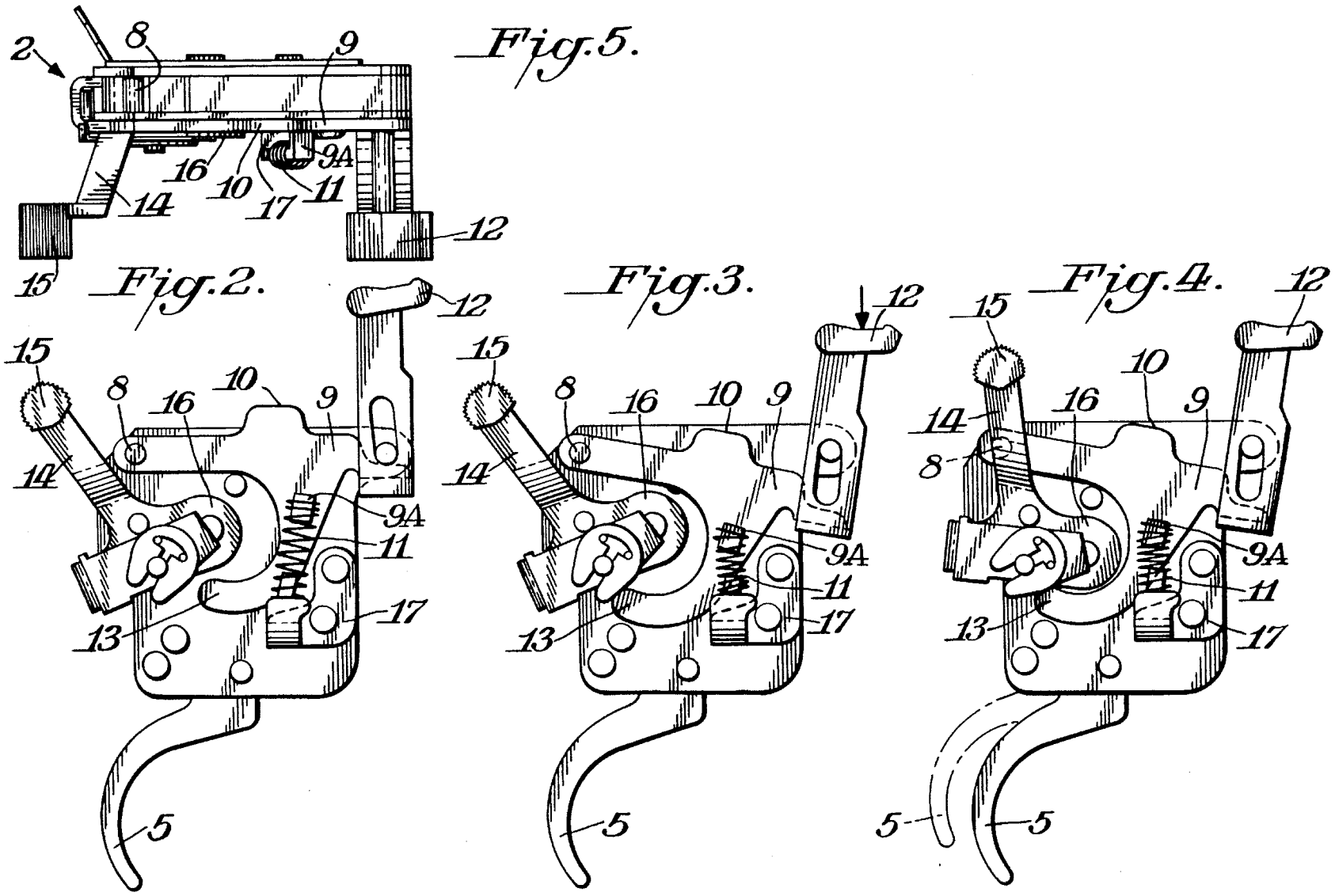
FIG. 2 is a right side elevation view of the bolt lock mechanism of FIG. 1, showing the safety in the safe position and the bolt lock in a locked position.
FIG. 3 is a right side elevation view of the bolt lock mechanism of FIG. 1, showing the safety in the safe position and the bolt lock in an unlocked position.
FIG. 4 is a right side elevation view of the bolt lock mechanism of FIG. 1, showing the safety in the fire position and the bolt lock in an unlocked position.
FIG. 5 is a top plan view of the bolt lock mechanism shown in FIG. 2.

FIG. 2 shows a fight side elevation view of the bolt lock mechanism. Locking member 9 is pivotally mounted. The point of mounting is a matter of choice of the designer, and can be, for example, on the fire control mechanism or the receiver. Here, it is shown mounted on the fire control mechanism by pivotal mounting means 8, and is provided with tab 10, which secures the bolt when the bolt lock is in a locked position. The locking member is biased upward by coil spring 11 anchored to tab 9A on the locking member 9 and spring keeper 17. Downwardly and rearwardly projecting portion 13 of the bolt lock mechanism, is capable of slideably interacting with the safety actuating means 16. While the exact design of the downwardly and rearwardly projecting portion can vary widely, it is here shown in an arcuate configuration.

FIG. 3 shows the bolt lock in an unlocked position, which is accomplished by depressing the upwardly projecting control means 12 of the bolt lock assembly, in the direction shown by the arrow, thereby lowering the locking tab 10, and unsecuring the bolt.

FIG. 4 shows the interaction between the arcuate portion 13 of the locking member and safety actuating means 16. The safety mechanism is placed in a fire position, as shown in FIG. 4, by moving the safety lever 14 forward using the thumb manipulable head 15. FIG. 4 thus shows the bolt lock in the unlocked position and the safety in the fire position.

FIG. 5 shows the location of the upwardly projecting control means of the bolt lock and the thumb manipulable head of the safety when the bolt lock mechanism is installed in a rifle.

Figure 6:
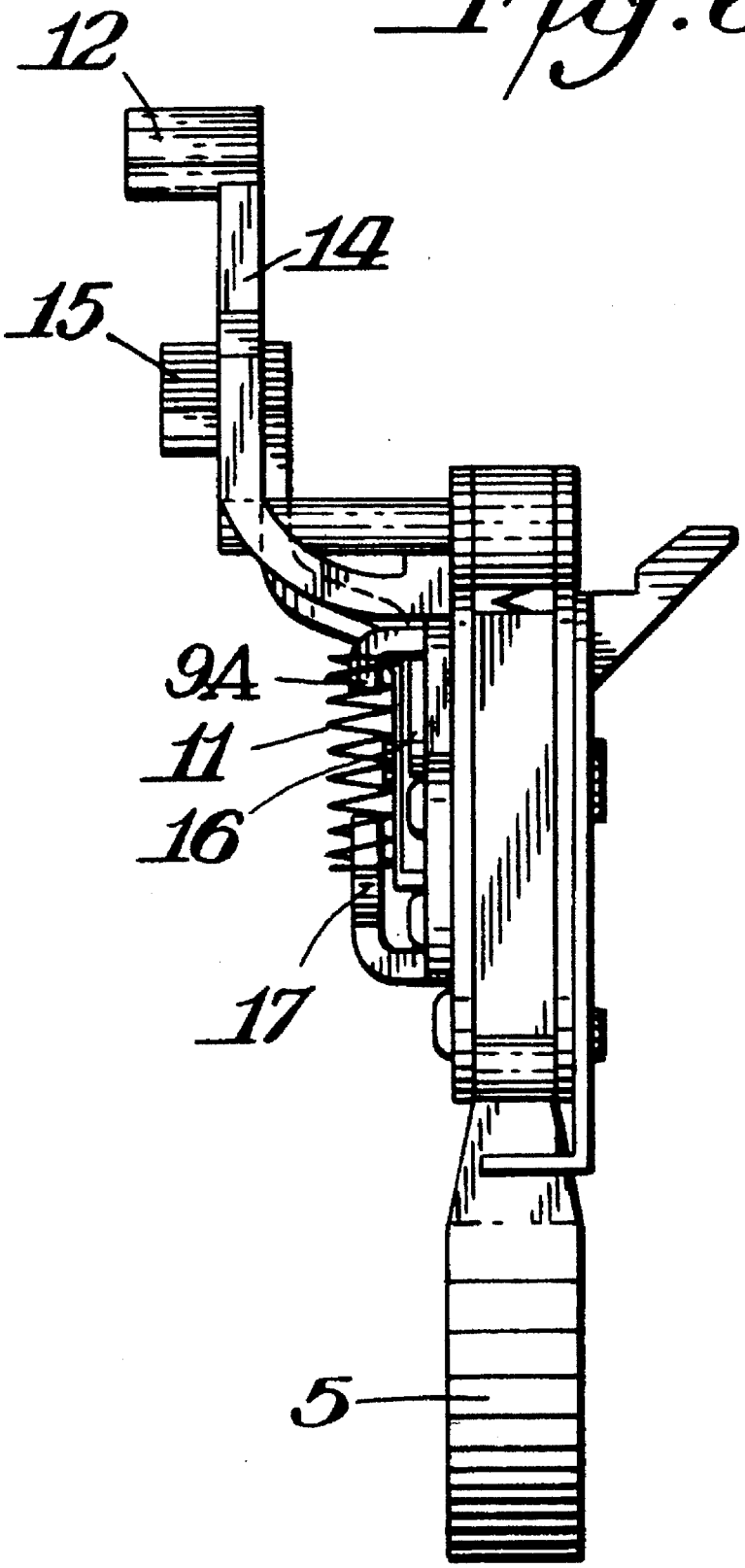
FIG. 6 is an end elevational view of the bolt lock mechanism of the present invention.

FIG. 6 is an end elevational view of the mechanism, further illustrating the positioning of spring 11 between tab 9A and spring keeper 17.

The present invention provides a simple and an efficient design for a bolt lock mechanism which offers the choice of holding the bolt lock in an unlocked position while maintaining the safety in the safe position. Such an arrangement offers the choice of unlocking the bolt independent of the safety mechanism.

The present invention continues to offer the choice of controlling the bolt lock mechanism through the safety mechanism. Thus, moving the safety to the safe position automatically places the bolt lock in a locked position, and moving the safety to a fire position automatically moves the bolt lock to an unlocked position. This arrangement facilitates the moving of the bolt lock assembly to a locked or an unlocked position in a single operation.

We claim:

1. In a bolt action firearm having a fire control mechanism, a two position safety, a safety actuating means to move the fire control mechanism between a safe and a fire position, a bolt and a bolt lock assembly including a bolt lock in operative relation to the bolt, the improvement wherein the bolt lock assembly comprises a pivotally mounted locking member to move between a locked and an unlocked position, the locking member having a tab which secures the bolt in the locked position and a downwardly and rearwardly extending portion which slideably interacts with the safety actuating means, the locking member having an upwardly projecting control means for moving the locking member between a locked and an unlocked position; and a spring and an associated spring keeper, the spring biasing the bolt lock to the locked position; the downwardly and rearwardly extending portion of the locking member slideably interacting with the safety in a manner such that moving the safety from a fire position to a safe position moves the bolt lock from an unlocked to a locked position; and wherein the upwardly projecting control means can manually overcome the spring bias to move the bolt lock to an unlocked position.

2. A firearm control mechanism of claim 1 wherein the locking member is mounted on the fire control mechanism.

3. A firearm control mechanism of claim 1 wherein the locking member is mounted on the receiver.

4. A firearm control mechanism of claim 1 wherein the downwardly and rearwardly extending portion is arcuate in configuration.

* * * * *